US008931384B2

(12) United States Patent
Davis et al.

(10) Patent No.: US 8,931,384 B2
(45) Date of Patent: Jan. 13, 2015

(54) SLICING APPARATUS

(71) Applicant: D & T Products, Inc., Strasburg, OH (US)

(72) Inventors: Michael A. Davis, Dover, OH (US); Christopher T. Troyer, Strasburg, OH (US)

(73) Assignee: D & T Products, Inc., Strasburg, OH (US)

( * ) Notice: Subject to any disclaimer, the term of this patent is extended or adjusted under 35 U.S.C. 154(b) by 0 days.

(21) Appl. No.: 14/143,876

(22) Filed: Dec. 30, 2013

(65) Prior Publication Data

US 2014/0109745 A1 Apr. 24, 2014

Related U.S. Application Data

(62) Division of application No. 12/711,046, filed on Feb. 23, 2010, now Pat. No. 8,616,105.

(60) Provisional application No. 61/279,879, filed on Oct. 27, 2009.

(51) Int. Cl.
*B26D 7/06* (2006.01)

(52) U.S. Cl.
USPC ..... 83/435.17; 83/425

(58) Field of Classification Search
USPC ..... 83/39, 42, 47, 618, 620, 435.17, 425
See application file for complete search history.

(56) References Cited

U.S. PATENT DOCUMENTS

| | | | |
|---|---|---|---|
| 13,475 | A | 8/1855 | Ketcham |
| 252,325 | A | 1/1882 | Moore |
| 507,383 | A | 10/1893 | O'Connell |
| 533,164 | A | 1/1895 | Criswell |
| 563,652 | A | 7/1896 | Bulette |
| 590,129 | A | 9/1897 | Bulette |
| 608,368 | A | 8/1898 | Lawson |
| 723,729 | A | 3/1903 | Powles, Sr. |
| 1,046,551 | A | 12/1912 | Cass |
| 1,320,294 | A | 10/1919 | Todd |
| 1,379,724 | A | 5/1921 | Russell |
| 1,478,684 | A | 12/1923 | Taylor et al. |
| 1,668,286 | A | 5/1928 | Powell |
| 1,805,376 | A | 5/1931 | Samson |
| 2,153,407 | A | 4/1934 | Bell |
| 2,046,396 | A | 7/1936 | Matter et al. |
| 2,093,755 | A | 9/1937 | Garfunkel |
| D117,762 | S | 11/1939 | Strauss |
| 2,283,029 | A | 5/1942 | Bakewell |

(Continued)

OTHER PUBLICATIONS

Shaver Specialty Company, Torrance, CA, Keen Kutter Product Catalog, Date Unknown.

(Continued)

*Primary Examiner* — Sean Michalski
(74) *Attorney, Agent, or Firm* — Roger A. Gilcrest

(57) ABSTRACT

In general terms, the present invention includes a slicing apparatus for vegetables powered by a pneumatic actuator. The present invention includes a slicing apparatus comprising: (a) a base portion defining a slicing area; (b) an actuator support portion, the actuator support portion adapted to be releasably connected to the base portion; and (c) an actuator, attached to the actuator support portion, the actuator comprising a drive rod and push block, the push block releasably connected to the drive rod; and (d) a slicing blade portion attached to the base portion and disposed such that the drive rod urges the push block toward the slicing blade portion.

13 Claims, 8 Drawing Sheets

(56) References Cited

U.S. PATENT DOCUMENTS

| | | | | |
|---|---|---|---|---|
| 2,343,448 | A | 3/1944 | Fay | |
| 2,407,924 | A | 9/1946 | Garfunkel | |
| 2,464,993 | A | 3/1949 | Ross | |
| 2,470,934 | A | 5/1949 | La Bat | |
| 2,489,581 | A | 11/1949 | Mason | |
| 2,522,143 | A | 9/1950 | Strassenburg | |
| 2,644,194 | A | 7/1953 | Fill | |
| 2,647,549 | A | 8/1953 | Koch | |
| 2,733,508 | A | 2/1956 | Carter | |
| 2,790,474 | A | 4/1957 | Norton, Sr. | |
| 2,836,212 | A | 5/1958 | Shaw | |
| D183,511 | S | 9/1958 | Chesney et al. | |
| 2,852,053 | A | 9/1958 | Berry et al. | |
| 3,112,781 | A | 12/1963 | Popeil | |
| 3,187,432 | A | 6/1965 | Cuomo | |
| 3,211,202 | A | 10/1965 | Mason | |
| 3,216,474 | A | 11/1965 | Popeil | |
| 3,283,730 | A | 11/1966 | Mohler | |
| 3,519,050 | A | 7/1970 | Dobrinen | |
| 3,565,145 | A | 2/1971 | Sanders et al. | |
| 3,687,688 | A | 8/1972 | Stapley et al. | |
| 3,815,456 | A | 6/1974 | Braathen et al. | |
| 3,830,151 | A | 8/1974 | Gerson | |
| 3,832,875 | A | 9/1974 | Newman | |
| 3,874,259 | A | 4/1975 | Chambos et al. | |
| 3,880,295 | A | 4/1975 | Wyslotsky | |
| 3,933,070 | A | 1/1976 | Walters et al. | |
| 3,952,621 | A | 4/1976 | Chambos | |
| 3,987,696 | A | 10/1976 | Haas et al. | |
| 3,994,326 | A | 11/1976 | Sarten | |
| 4,062,260 | A | 12/1977 | Steinhogl | |
| 4,254,678 | A | 3/1981 | Steiner et al. | |
| 4,342,242 | A | 8/1982 | Schaum | |
| 4,436,025 | A | 3/1984 | Jones | |
| 4,619,192 | A | 10/1986 | Cycyk et al. | |
| D293,411 | S | 12/1987 | Dickey | |
| 4,759,168 | A | 7/1988 | Petersen et al. | |
| 4,819,541 | A | 4/1989 | Pitsch et al. | |
| 4,979,418 | A | 12/1990 | Covert et al. | |
| D326,388 | S | 5/1992 | Boerner | |
| 5,121,679 | A | 6/1992 | Mertz | |
| 5,127,616 | A | 7/1992 | Carney | |
| 5,129,298 | A | 7/1992 | Cresson et al. | |
| 5,245,902 | A | 9/1993 | Pereira | |
| 5,271,317 | A | 12/1993 | Aguerrevere et al. | |
| 5,343,791 | A | 9/1994 | Julian et al. | |
| D373,926 | S | 9/1996 | White et al. | |
| D383,940 | S | 9/1997 | Davis et al. | |
| D414,076 | S | 9/1999 | Davis et al. | |
| D448,968 | S | 10/2001 | Davis et al. | |
| 7,439,444 | B1 * | 10/2008 | Maltby et al. | 174/66 |
| 7,598,453 | B1 * | 10/2009 | Shotey et al. | 174/66 |
| 2004/0108738 | A1 * | 6/2004 | Marry | 294/1.1 |

OTHER PUBLICATIONS

D&T Products, Strasburg, OH, Air Powered Vegetable Cutter Specification Sheet, Date Unknown.

TS Designs, Inc., 945 West 13th Street, Burley, ID 83318; website—www.tsdesigns.org, Cutters, Apr. 2, 2010.

* cited by examiner

SLICING APPARATUS

RELATED APPLICATION DATA

This application is a divisional of U.S. application Ser. No. 12/711,046, filed Feb. 23, 2010, which claims the priority benefit of U.S. Provisional Application Ser. No. 61/279,879, filed Oct. 27, 2009, which are hereby incorporated in their entirety herein by reference.

BACKGROUND OF THE INVENTION

Devices for the type to which the present invention relates includes those for slicing food products, such as vegetables, for food service and restaurant operations.

This invention is an improvement upon slicing and cutting devices commercially available devices, such as those from commercially available from Shaver Specialty of Torrance, Calif. and Nemco Food Equipment of Hicksville, Ohio.

Other versions of these food slicing devices have been rendered in embodiments that provide for machine action rather than hand actuation. However, there remains a need for improvements in such devices.

It is desirable to have a safe, automatic, easy-to-use system for slicing vegetables in high volumes with little effort.

In addition, it is desirable to be able to dismantle the system for easy cleaning for sanitary purposes, and to be able to replace portions of the device with operative portions where the device fails in part, to allow for continued operation without substantial downtime. This is particularly important in the food service and restaurant industries where heavy duty versions of these devices find application.

It is also desirable to have an apparatus that may be mounted on a table or on a wall that is able to be removed from the table or wall, as this allows for some variation in installation and use to accommodate different application environments.

It is also desirable to have an apparatus in which the vegetable or other item to be sliced does not become dislodged and can be held in position for slicing.

It is also desirable to have an apparatus in which several vegetables or other food items may be sliced in rapid and automatic succession while being safe to operate for the user.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

SUMMARY OF THE INVENTION

It is desirable, in food preparation, for the cutting surface to be separable from the powered portion (e.g. pneumatic, electric or hydraulic) for cleaning and sanitation, and for ready replacement in the event of failure or wear.

Additionally, the powered actuator and the cutting surface preferably are each attached only at one point, such as by using removable pins and the like, for easy dismantling, rendering the device detachable at two points.

The device is designed to slice a vegetable, such as a potato, when the cover is closed. Upon closing the cover, a switch is triggered allowing the air to flow through the inlet valve, into the actuator, and back out again. Raising the cover disengages the system. Vegetables thereby can be sliced more efficiently and safely using the apparatus of the present invention.

Mounting plates allow the slicer to be mounted either on a wall or on a horizontal surface. In one preferred embodiment, when wall mounting is desirable, the angle of the mounting plate positions the bottom of the apparatus slightly further away from the wall so that the vegetable may rest easily on the cutting surface. This may be done by using an angled mounting plate that attaches to the wall and the balance of the apparatus, to cause the cutting or blade surface to be angled toward the wall (i.e., in such a way to have the food piece resist falling from the cutting or blade surface once placed there prior to the initiation of the slicing action).

In general terms, the present invention includes a slicing apparatus for vegetables powered by a pneumatic, electric or hydraulic actuator, as well as a mounting arrangement for vertical disposition of the device.

The present invention includes a slicing apparatus comprising: (a) a base portion defining a slicing area; (b) an actuator support portion, the actuator support portion adapted to be releasably connected to the base portion; and (c) an actuator, attached to the actuator support portion, the actuator comprising a drive rod and push block, the push block releasably connected to the drive rod; and (d) a slicing blade portion attached to the base portion and disposed such that the drive rod urges the push block toward the slicing blade portion.

The invention includes a removable cover adapted to be moved between an open position and a closed position over the slicing area. A removable cover is desirable to prevent injury to the user, and to hold the food item, such as a whole vegetable or fruit or portion thereof, in place for slicing or dicing. It also helps maintain the cutting area relatively free of contaminants as the food item is being cut. The cover also is advantageous for ease of cleaning and storage when not in use. It is preferred that the cover be translucent or transparent in order that the operator might view the action of the apparatus. The cover preferably may be of a plastic material, such as clear Mylar or the like.

In one embodiment of the invention, a switch controlling the actuator is activated upon closure of the cover over the slicing area. Raising the cover disengages the system. This is desirable for safety because the drive rod and push block system, which forces the vegetable into the blade, will not function while the cover is open or off.

In this same regard, the invention is not limited to the size of the slicing region volume or the length of the drive rod, as this may be varied depending upon the size of the food piece or other work piece desired to be sliced or diced.

The actuator support portion is releasably connected to the base portion by a removable pin. This removable connection point allows for ease in dismantling. The removable pin allows the actuator to be removed from the base for cleaning or storage.

The push block is releasably connected to the drive rod by a removable pin. Removing the pin allows for dismantling of components for easier cleaning.

The slicing apparatus is powered by a pneumatic actuator. The pneumatic system allows compressed air to be forced through the actuator cylinder to force the push block toward the slicing blade. Alternatively, the pneumatic actuator may be removed and a manpowered handle affixed to power the machine. This is desirable to allow for continued operation should the pneumatic actuator stop functioning.

In one embodiment, the slicing apparatus is adapted to be mounted on a vertical wall surface using a mounting plate adapted to be permanently attached to a vertical wall surface or to a base surface using a removable base-mounting plate. When the wall mounting plate is attached to a wall and the apparatus base portion, the drive rod is maintained at an angle to the vertical wall surface. The angle allows positioning of the bottom of the apparatus slightly further away from the wall so that the vegetable may rest easily on the cutting surface.

Accordingly, the present invention also includes, as another variation, a slicing apparatus comprising: (a) a base portion defining a slicing area; (b) an actuator support portion, the actuator support portion adapted to be releasably connected to the base portion by a removable pin; and (c) an actuator, attached to the actuator support portion, the actuator comprising a drive rod and push block, the push block releasably connected to the drive rod by a removable pin; and (d) a slicing blade portion attached to the base portion, and disposed such that the drive rod urges the push block toward the slicing blade portion; (e) a cover adapted to be removably placed over the slicing area; and (f) a mounting plate to be permanently attached to a vertical wall surface and being arranged at an angle to a wall such that, when the mounting plate is attached to the wall and the base portion, the drive rod is maintained at an angle to the vertical wall surface and/or, such that the surface of the blade(s) is maintained at an angle toward the vertical wall, such that the food piece is maintained in a position awaiting the action of the push block.

Another embodiment of the invention includes a slicer device with the actuator supported on the base through a single point releasable attachment, that being attaching the actuator at one end of the base portion. This embodiment includes a slicing apparatus comprising: (a) a base portion defining a slicing area and having a first and second end; (b) an actuator having a first and second end, attached to the actuator support portion only by the first end of the actuator being attached to the first end of the base portion while the second end of the actuator is unsupported, the actuator comprising a drive rod and push block; and (c) a slicing blade portion attached to the base portion, and disposed such that the drive rod urges the push block toward the slicing blade portion.

The invention includes a removable cover adapted to be moved between an open position and a closed position over the slicing area. A removable cover is desirable for ease of cleaning and storage.

In one embodiment of the invention, a switch controlling the actuator is activated upon closure of the cover over the slicing area. Raising the cover disengages the switch that causes actuation of the drive rod, and conversely causes the actuator to urge the drive rod toward the ready position. This is desirable for safety because the drive rod and push block system, which forces the vegetable into the blade, will not function while the cover is open or off.

The actuator support portion is releasably connected to the base portion by a removable pin. This removable connection point allows for ease in dismantling. The removable pin allows the actuator to be removed from the base for cleaning or storage.

The push block is releasably connected to the drive rod by a removable pin. Removing the pin allows for dismantling of components for easier cleaning.

The slicing apparatus is powered by a pneumatic actuator. The pneumatic system allows compressed air to be forced through the actuator cylinder to force the push block toward the slicing blade. The pneumatic actuator preferably is reversible, such that it may also be driven by reverse action to the ready position. This is typically done by using an alternating air source applying air pressure in the opposite direction, such that the duty cycle of the device can be completed by closing, and then opening the cover. This allows for safe and efficient operation by opening the cover, placing a food piece in the cutting space, closing the cover to actuate the cutting stroke, and then opening the cover to cause the actuator to return the push rod to the ready position.

In one embodiment, the slicing apparatus is adapted to be mounted on a vertical wall surface using a mounting plate adapted to be permanently attached to a vertical wall surface or to a base surface using a removable base-mounting plate. When the wall mounting plate is attached to a wall and the apparatus base portion, the drive rod is maintained at an angle to the vertical wall surface. The angle allows positioning of the bottom of the apparatus slightly further away from the wall so that the vegetable may rest easily on the cutting surface.

The present invention also includes a slicing apparatus comprising: (a) a base portion defining a slicing area and having a first and second end; (b) an actuator having a first and second end, attached to the actuator support portion only by the first end of the actuator being attached to the first end of the base portion while the second end of the actuator is unsupported, the actuator comprising a drive rod and push block; (c) a slicing blade portion attached to the base portion, and disposed such that the drive rod urges the push block toward the slicing blade portion; and (d) a cover adapted to be removably placed over the slicing area.

It is preferred that the actuator support portion is adapted to be releasably connected to the base portion by a removable pin, and wherein the push block is releasably connected to the drive rod by a removable pin.

In another embodiment, the slicing apparatus may be adapted to be mounted on a vertical wall surface either directly, or by the slicing apparatus by use of an additional mounting plate having a base-mounting surface and a wall-mounting surface, the base-mounting surface adapted to be removably attached to the base portion, and the wall-mounting surface adapted to be permanently attached to a vertical wall surface, the base-mounting surface and the wall-mounting surface being arranged at an angle to one another such that, when the mounting plate is attached to the wall and the base portion, the drive rod is maintained at an angle to the vertical wall surface. The angle allows positioning of the bottom of the apparatus slightly further away from the wall so that the vegetable may rest easily on the cutting surface while being urged slightly toward the vertical wall. The angle may vary depending upon the desired application, but typically and preferably will be a slight acute angle, such as that between 5 and 15 degrees.

It will be appreciated that the inventions disclosed herein may be applied independently to the apparatus and mounting systems of the present invention.

DETAILED DESCRIPTION OF THE PREFERRED EMBODIMENTS

In accordance with the foregoing summary, the following provides a detailed description of the preferred embodiment, which is presently considered to be the best mode thereof.

Figure 1:
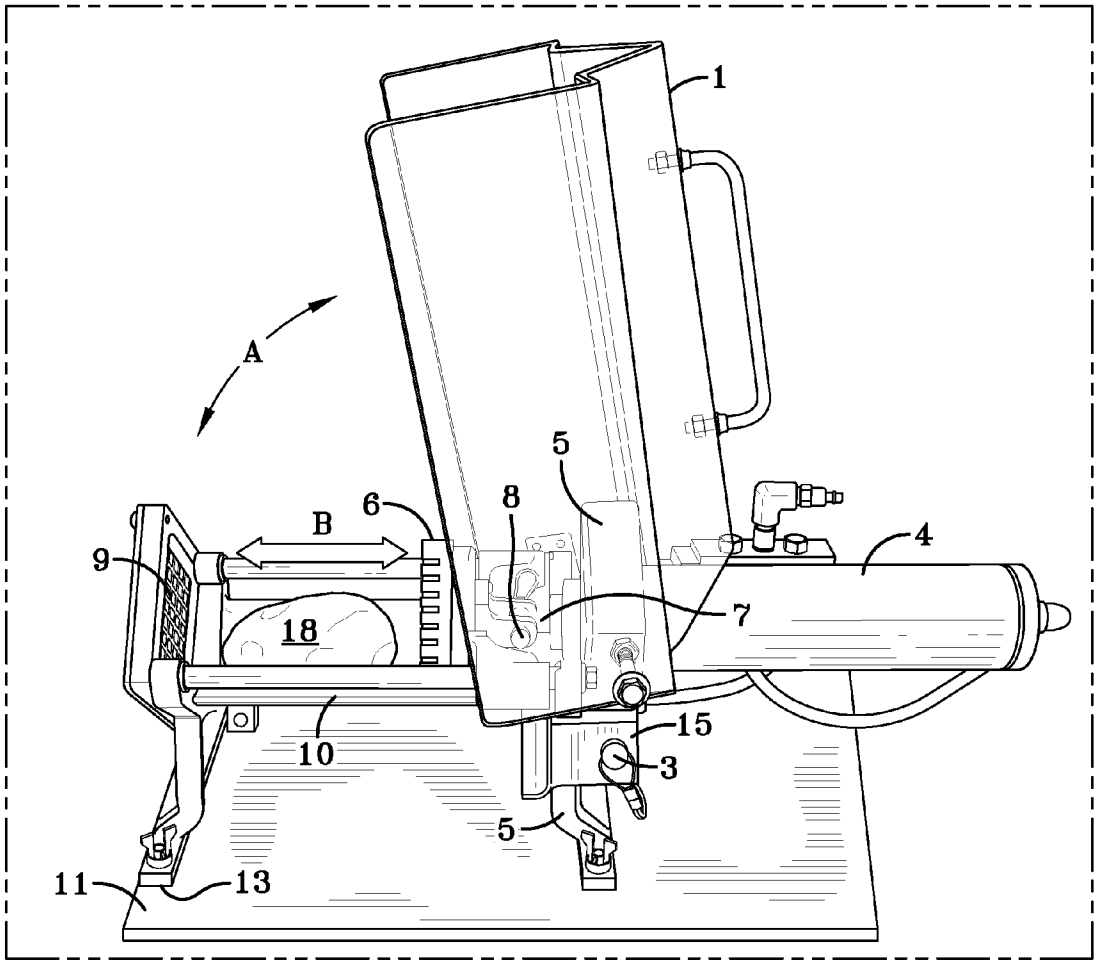
FIG. 1 is a top perspective view of a slicing apparatus in accordance with one embodiment of the present invention.

FIG. 1 is a top perspective view of a slicing apparatus in accordance with one embodiment of the present invention. FIG. 1 shows a slicing apparatus with the optional and preferred cover 1 in the open position, the cover preferably being hinged so as to be reversibly moved along direction line A. As shown it is designed to slice vegetables, such as potatoes, by forcing the vegetable through the slicing blade 9 using a pneumatically driven push block 6. In this Figure, the apparatus is mounted on a base-mount 11 intended to secure the slicer to a horizontal surface. The slicer may be secured to the mount using feet 13 of the type shown.

FIG. 1 shows the apparatus fully assembled with the actuator 4 connected to the slicing base portion 10. The slicing base portion 10 contains the drive rod 7, push block 6, slicing blade 9, and slicing field. The actuator 4 is supported by the actuator support 5 which is connected to the base 10 via one or more removable pins, such as pin 3 allowing for dismantling. In the displayed embodiment, the actuator support 5 is attached to the slicing base portion 10 by a collar piece 15 that fits about the base portion 10 (such as around rear support 16) and is pinned in place by two pins 3 as can be appreciated as well from FIG. 5. It will also be appreciated that the actuator support 5 and the slicing base portion 10 may be of any shape so as to permit their releasable engagement to one another, and that such releasable engagement or attachment may be made by any appropriate means such as pins, hand screws, a slot-and-groove arrangement, magnets, etc. For instance, the slicing base portion 10 may have vertical slots or grooves formed into it, and the actuator support 5 may have correspondingly shaped extensions along its lateral sides adapted to fit into the slots or grooves to allow it to be removably placed in engagement therewith. It will be appreciated that any other such equivalent arrangements are within the scope of the invention.

FIG. 1 shows the device of the present invention in an open configuration, with a food piece, such as a potato 18, in position to be sliced. The actuator 4 causes drive rod 7 bearing push block 6 to be reciprocally moved along line B.

The slicing apparatus may be operated by placing a food piece or other item to be sliced (such as a vegetable; i.e., a potato), in the slicing field and closing the cover 1. Closure of the cover 1 activates the pneumatic controls 2 which force air through the actuator 4 into the drive rod 7 which propels the push block 6 forward. Propelling the push block 6 forward forces the vegetable through the slicing blade 9 where it is cut. Once cut, the vegetable pieces fall into a receptacle. Raising the cover resets the system by actuating the pneumatic actuator in the opposite direction, returning it to the ready position and allowing the placement of a subsequent food piece. This may be done in relatively rapid succession by the operator operating the cover with one hand and loading the slicing apparatus with the other hand, making operation, clean, safe and efficient.

The apparatus of the present invention may be mounted or placed on a table or other horizontal surface or on a vertical surface, such as on the side of a cabinet or on a wall. The vertical orientation, wherein the cutting blades or surface are angled from the horizontal, and most preferably toward the wall to which the device is attached, allows the vegetable to rest in the slicing field without falling out until the cover 1 is closed and the system activated.

Figure 2:
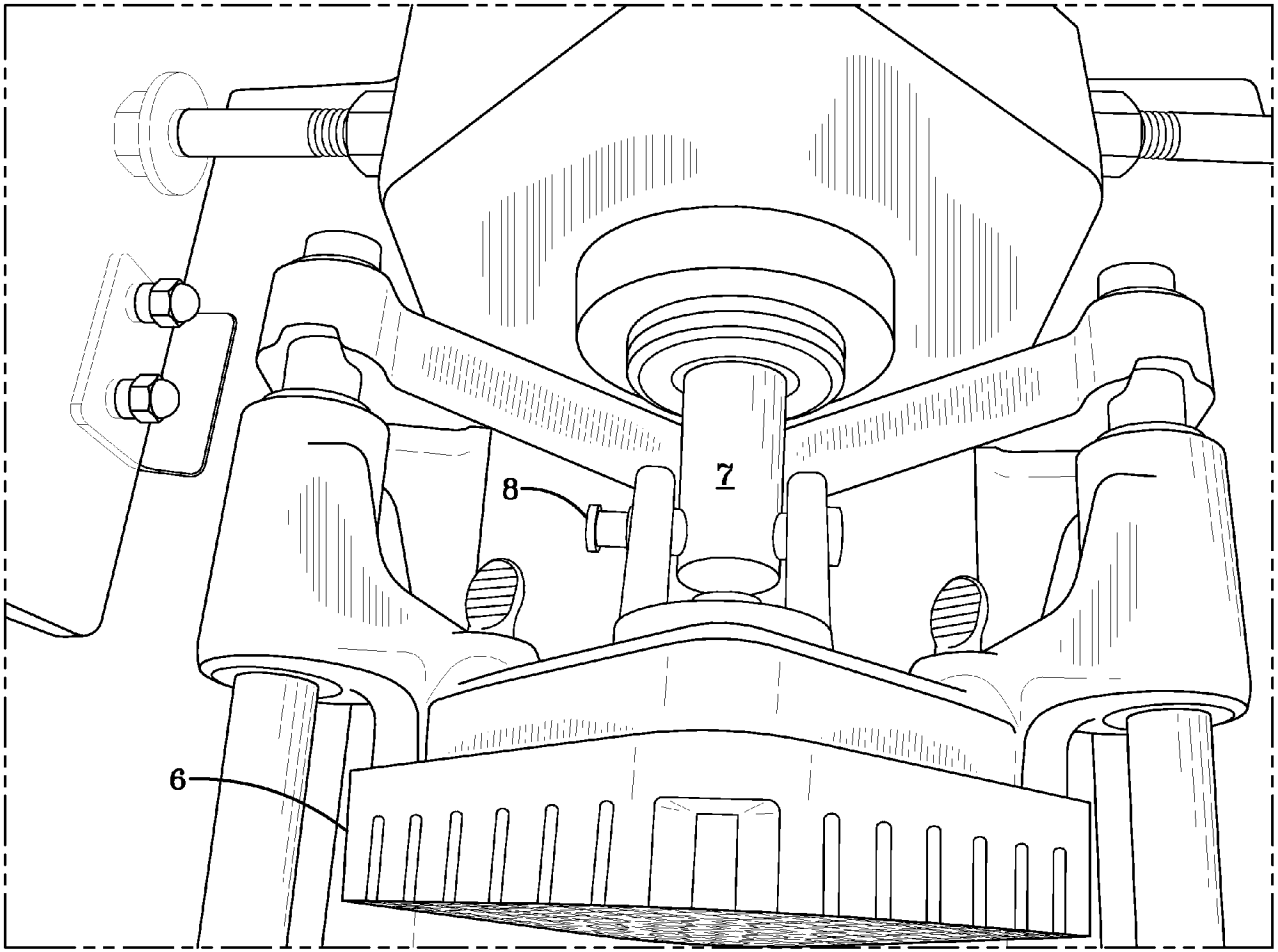
FIG. 2 is a detailed top perspective view of a drive rod, push block, and removable pin in accordance with one embodiment of the slicing apparatus of the present invention.

FIG. 2 is a detailed top perspective view of a drive rod 7, push block 6, and removable pin 8 in accordance with one embodiment of the slicing apparatus of the present invention. FIG. 2 shows drive rod 7, push block 6, and removable pin 8 in the attached configuration. The removable pin 8 shown in the center of the Figure allows the push block 6 to be reversibly attached from the drive rod 7. This allows the apparatus to be fully cleaned and sanitized, or to have replacement of alternative parts supplied. For instance, the push block 6 is typically shaped, usually with grooves, to correspond to the array of blades in the slicing blade assembly 9, so the present invention allows both the slicing blade assembly 9 (which typically are removably attached for cleaning) and the push block 6 to be replaced in mating sets.

It will also be appreciated that the drive rod 7 and push block 6 may be of any shape so as to permit their releasable engagement to one another, and that such releasable engagement or attachment may be made by any appropriate means such as pins, hand screws, a threaded bore arrangement in the drive rod into which a threaded piece (wherein the yolk shown in FIG. 2 is replaced by a threaded rod), interference fit, clips or tines or flanges, etc. It will be appreciated that any other such equivalent arrangements are within the scope of the invention.

Figure 3:
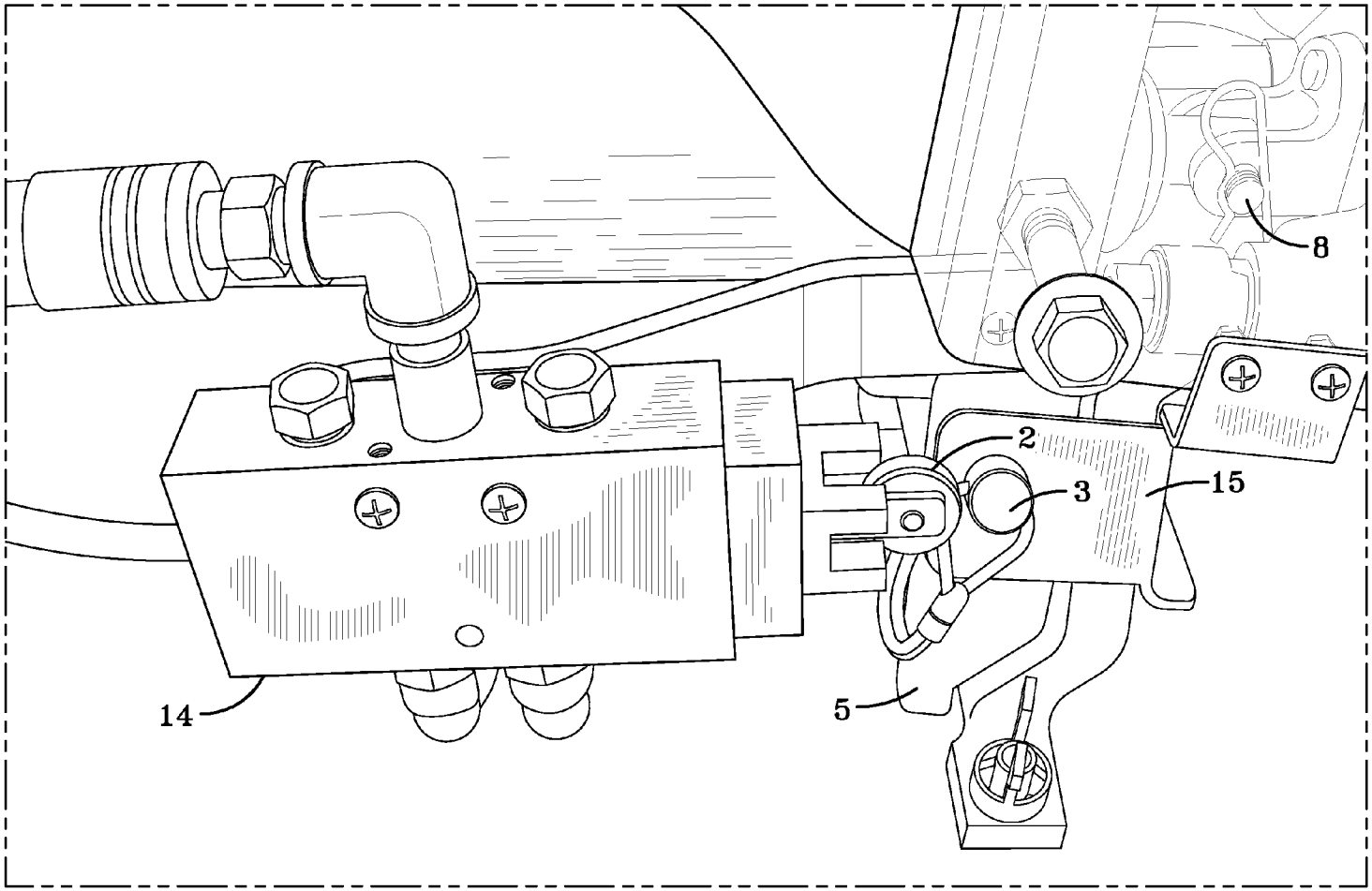
FIG. 3 is a detailed side perspective view of the actuator and controls, in accordance with one embodiment of the slicing apparatus of the present invention.

FIG. 3 is a detailed side perspective view of the actuator and controls, in accordance with one embodiment of the slicing apparatus of the present invention. FIG. 3 shows a detailed view of the control switch 2 and control housing 14. The control switch 2 is activated by the lowering of the cover 1. While the cover 1 is in the up/open position, the control switch 2 is not engaged, and this acts as a safety feature as well as preventing contamination during the cutting action. This Figure also shows the removable pins 3 and 8 which allow the apparatus to be dismantled. Removing the lower pins 3 allows the collar 15 to be removed and the actuator 4 to be separated from the base 10. Removing the upper pin 8 allows the drive rod 7 to be removed from the push block 6 allowing for ease in cleaning.

Figure 4:
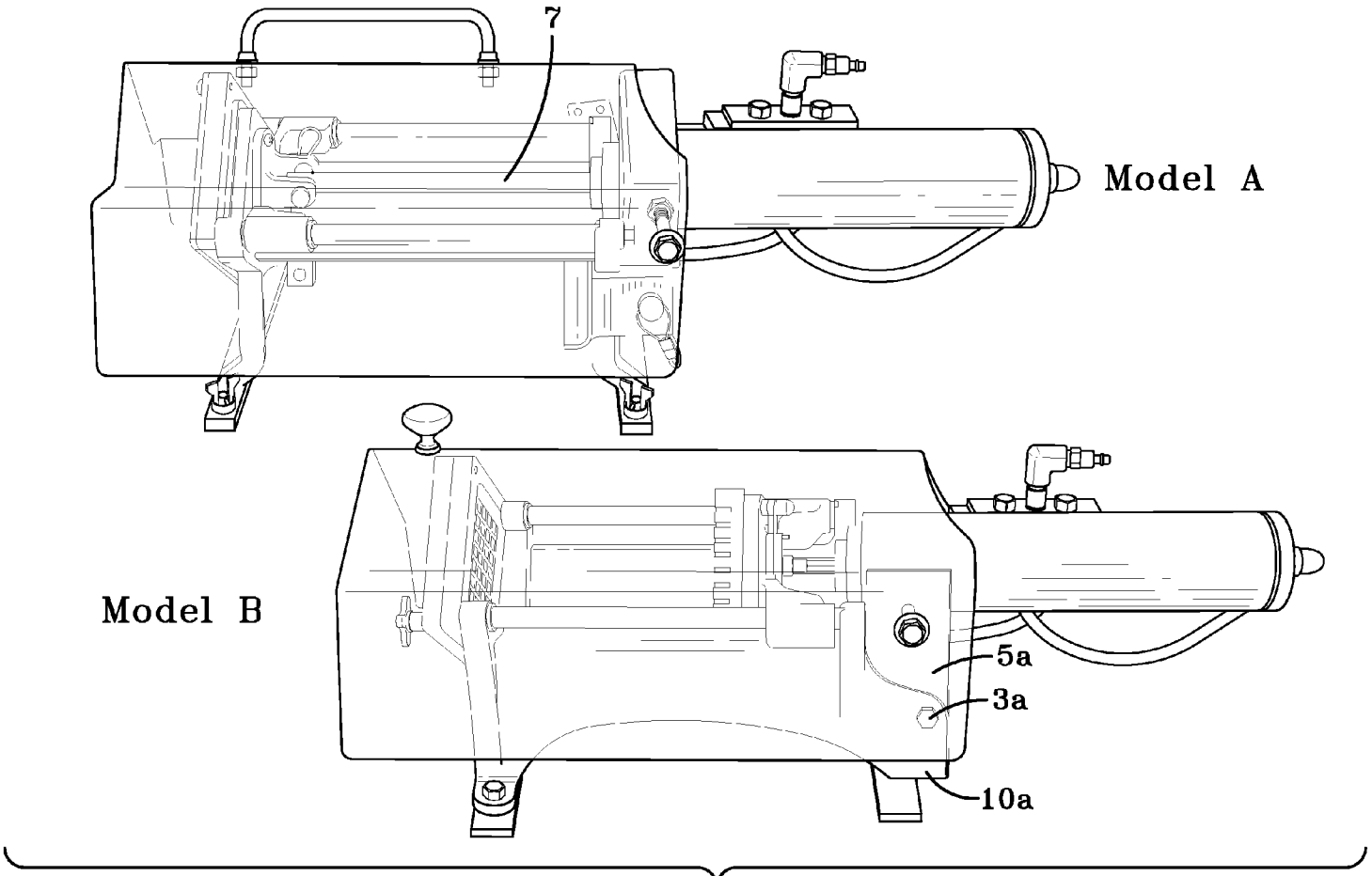
FIG. 4 is a side perspective view of two versions of the slicing apparatus in accordance with two embodiments of the present invention.

FIG. 4 is a side perspective view of two versions of the slicing apparatus in accordance with two embodiments of the present invention. FIG. 4 shows two possible embodiments of the present invention. In Model A, the drive rod 7 can be seen in the fully extended position. Model B shows an additional base style. Model B also shows the push block 6 in the fully retracted position. Model B also shows a slightly different arrangement for the slicing base portion and the actuator support portion. This arrangement shows that slicing base portion 10*a* and actuator support portion 5*a* may be directly attached by a bolt or pin 3*a*. It will be appreciated that any other such equivalent arrangements are within the scope of the invention.

Figure 5:
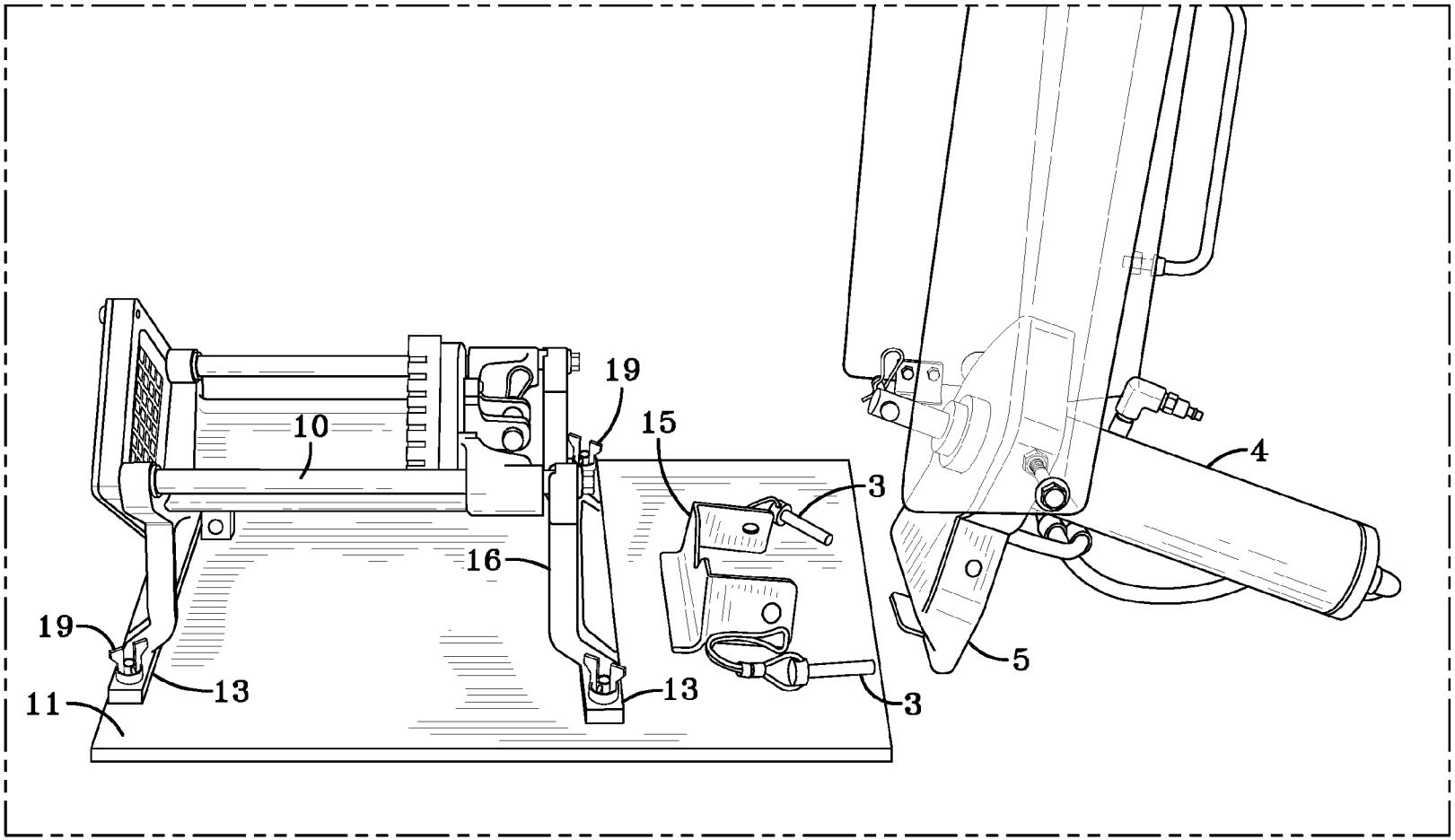
FIG. 5 is an elevation view of a dismantled slicing apparatus in accordance with one embodiment of the present invention.

FIG. 5 is an elevation view of a dismantled slicing apparatus in accordance with one embodiment of the present invention. FIG. 5 shows the slicing base portion 10 of the apparatus separated from the actuator 4 portion. The feet 13 of the slicing base portion 10 may be attached to the base mount 11 by wing nuts 19 or any other permanent or releasable attachment, to secure the apparatus. The base mount 11 and slicing base portion 10 may be separated in this configuration by unscrewing the wing nuts 19. In the center of the Figure are the collar 15 and removable pins 3 which allow for the separation. The collar 15 wraps around both the actuator support 5 and the rear support 16 of the slicing base portion 10 and is secured using two removable pins 3.

As can be appreciated from this Figure, the slicing base portion 10 may be mounted to a vertical or even angled surface as the desired application requires or allows.

Figure 6:
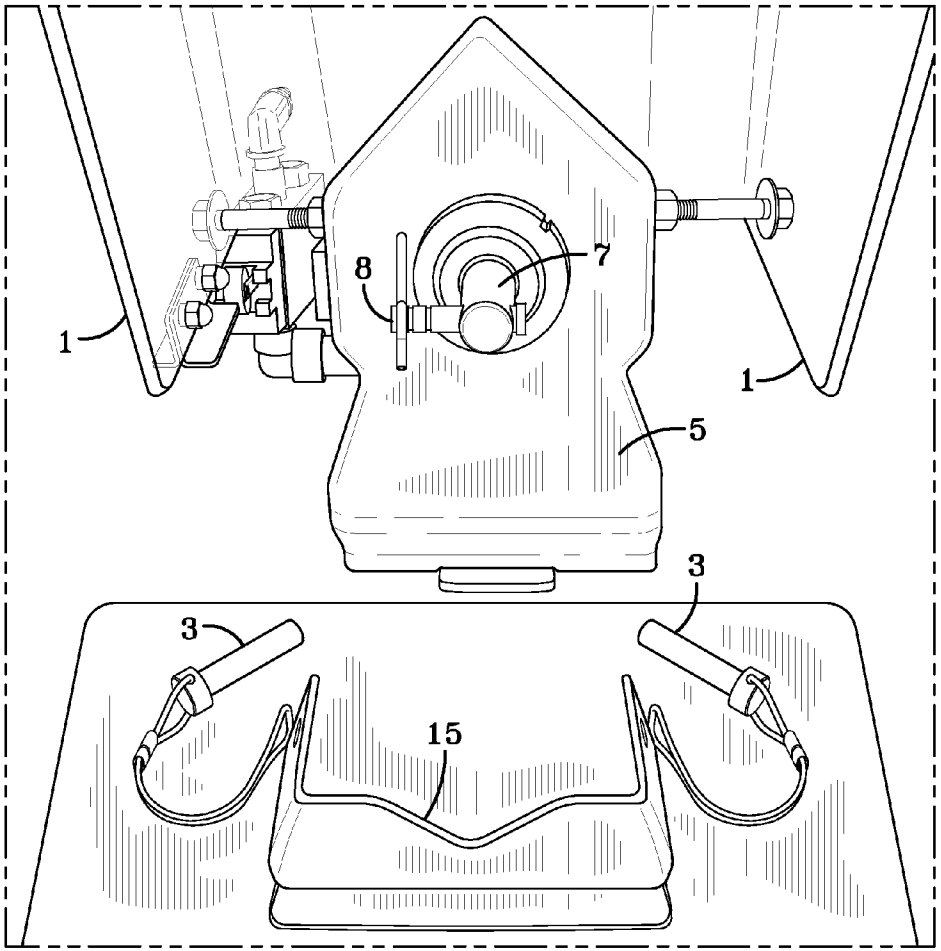
FIG. 6 is a detailed view of a push block, removable pins and collar of a slicing apparatus in accordance with one embodiment of the present invention.

FIG. 6 is a detailed view of the actuator support 5, drive rod 7, removable pins 3 and collar 15 of a slicing apparatus in accordance with one embodiment of the present invention, and shown in a disassembled condition. FIG. 6 shows the details of the actuator support 5 and attachment mechanism of the drive rod 7 and removable pin 8 that extend from the actuator support 5. The pin 8 shown secures the drive rod 7 to the push block 6. The collar 15, which wraps around both the actuator support 5 and base portion 10, is shown with the removable pins 3 which secure the two portions together.

Figure 7:
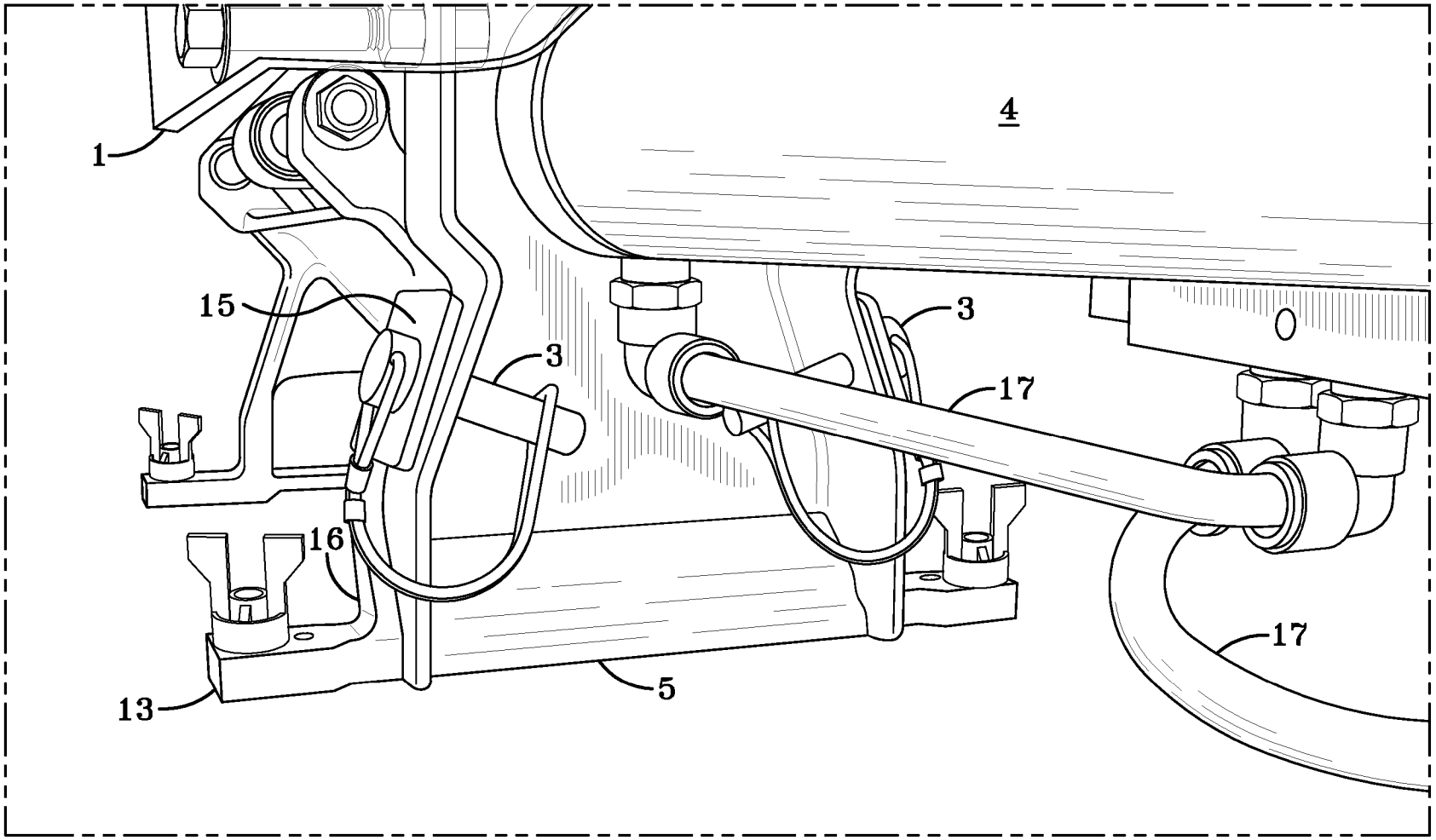
FIG. 7 is a detailed underside perspective view of an actuator support configuration, in accordance with one embodiment of the present invention.

FIG. 7 is a detailed underside perspective view of an actuator support configuration, in accordance with one embodiment of the present invention. FIG. 7 shows a detailed view of the actuator support 5 when the apparatus is assembled. The removable pins 3 secure the collar 15 around the actuator support 5 and rear support 16. The pneumatic hoses 17 are shown which supply air or other fluid to the actuator 4, which in this case is a pneumatic actuator which provides the required reciprocal movement of the drive rod 7.

Figure 8:
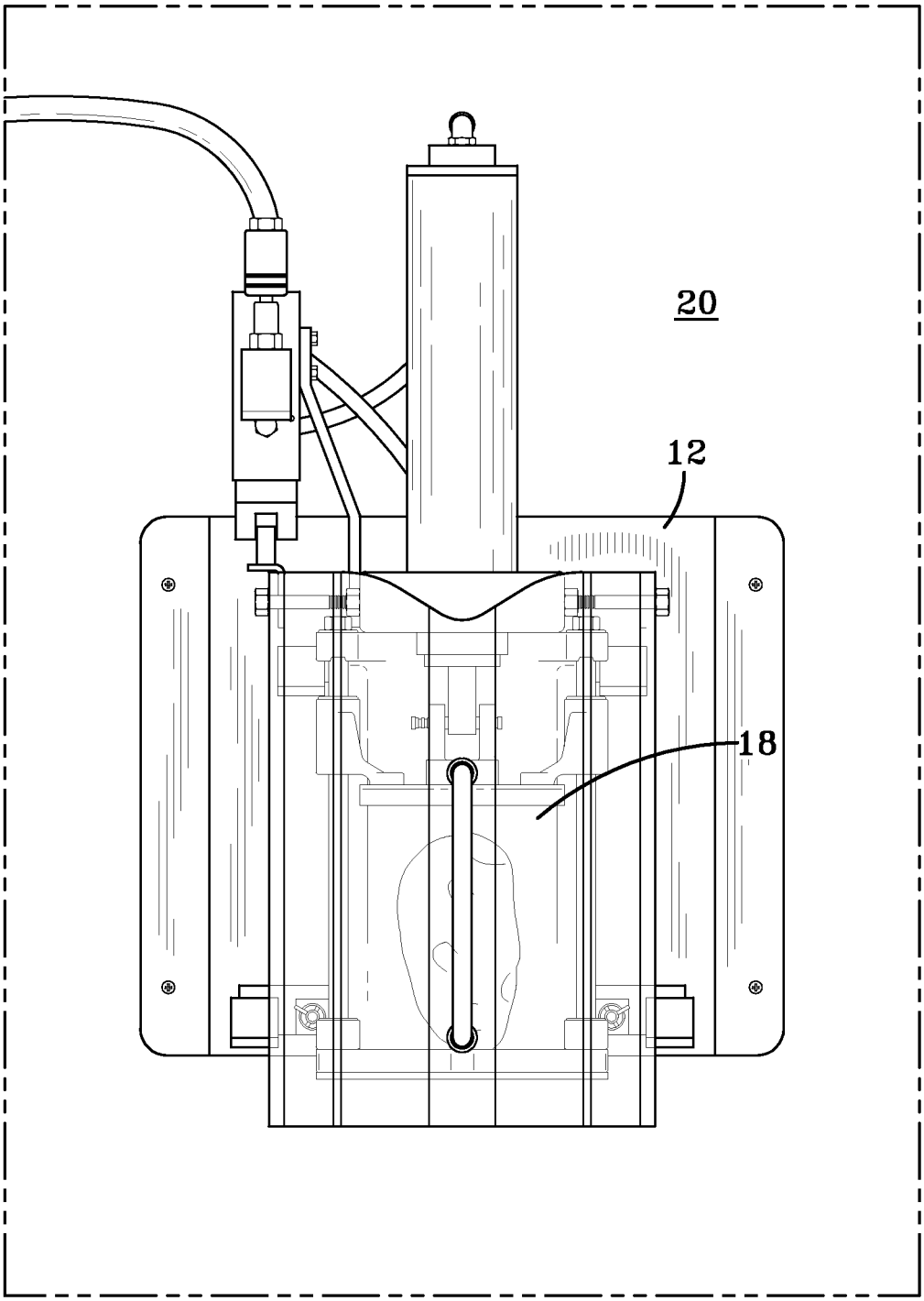
FIG. 8 is an elevation view of a slicing apparatus, shown mounted on a wall, in accordance with one embodiment of the present invention.

FIG. 8 is an elevation view of a slicing apparatus, shown mounted on a wall, in accordance with one embodiment of the present invention.

This may be done for instance by having the wall mounting plate 12 be provided with a wall attachment surface(s) or flange(s) while also presenting a slicing apparatus attachment surface(s) or flange(s) at an angle thereto.

FIG. 8 shows the slicing apparatus vertically mounted to a wall using the wall mounting plate 12, which is adapted to be either permanently or releasably attached to the wall 20, such as by screws or other fixtures or fixatives, as well as to be permanently or preferably releasably attached to the slicing apparatus. The wall mounting plate 12 may be either permanently or releasably attached to the wall 20 by screws, masonry screws, adhesives, etc. in the place of wing nuts shown in the horizontal position in FIG. 1.

The wall mounting plate 12 may be either or preferably releasably attached to the slicing apparatus by any fixture or fixative, but preferably may be hooks on or formed into the wall mounting plate 12 that engage with the slicing apparatus at one or more appropriate positions. This arrangement most preferably allows the entire device to be taken down for service, replacement or cleaning. In addition, the slicing apparatus can also be taken apart piecemeal, such as by removing the push block only, the actuator only, or the push block, actuator and slicing blades.

Wall mounting plate 12 may be made of any suitable material, typically aluminum, and preferably will provide a biased tilt to the slicing apparatus toward the wall to angle the slicing blade or blade field of slicing blade 9 such that the food piece 18 is maintained in the position to be cut. As can be appreciated from the drawings and description, there are a wide variety of mechanical arrangements that can bring about an angled positioning of the slicing blade or blade field of the present invention.

The slicing apparatus may be disposed over a bin or sink to catch the sliced food items, for further cleaning or processing.

The foregoing disclosure and description of the invention is illustrative and explanatory of presently preferred embodiments of the invention and variations thereof, and it will be appreciated by those skilled in the art, that various changes in the design, organization, order of operation, means of operation, equipment structures and location, methodology, the use of mechanical and electrical equivalents, such as different types of sensors, actuators and process steps than as illustrated, whereby different steps may be utilized, as well as in the details of the illustrated construction or combinations of features of the various elements may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. The relative size and arrangement of the components may be varied from that shown and the invention will still operate well within the spirit of the invention as described hereinbefore and in the appended claims. Thus, various changes and alternatives may be used that are contained within the spirit of the invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

What is claimed is:

1. A slicing apparatus comprising:

a. a base portion defining a slicing area and having a first and second end;

b. an actuator having a first and second end, attached to said actuator support portion only by said first end of said actuator being attached to said first end of said base portion while said second end of said actuator is unsupported, said actuator comprising a horizontally oriented drive rod and push block;

c. a slicing blade portion attached to said base portion, and disposed such that said drive rod urges said push block toward said slicing blade portion; and d. a cover adapted to be removably placed over said slicing area;

wherein said actuator support portion is adapted to be releasably connected to said base portion releasably connected to said base portion by a removable pin, and wherein said push block is releasably connected to said drive rod by a removable pin.

2. A slicing apparatus according to claim 1, wherein said actuator is a pneumatic actuator.

3. A slicing apparatus according to claim 1, wherein said apparatus additionally comprises a switch controlling said actuator and wherein said switch is activated upon closure of said cover over said slicing area.

4. A slicing apparatus according to claim 3, wherein said actuator is a pneumatic actuator.

5. A slicing apparatus according to claim 1, wherein said drive rod has a drive rod longitudinal axis and wherein said actuator is adapted to direct a driving force through said drive rod longitudinal axis.

6. A slicing apparatus according to claim 1, wherein said drive rod is adapted to reciprocate within said slicing area.

7. A slicing apparatus according to claim 1 wherein said base portion is adapted to contain and support an article to be sliced, and to permit the transport of said article within said slicing region.

8. A slicing apparatus comprising:

a. a base portion defining a slicing area and having a first and second end;

b. an actuator having a first and second end, attached to said actuator support portion only by said first end of said actuator being attached to said first end of said base portion while said second end of said actuator is unsupported, said actuator comprising a drive rod and push block;

c. a slicing blade portion attached to said base portion, and disposed such that said drive rod urges said push block toward said slicing blade portion; and d. a cover adapted to be removably placed over said slicing area;

wherein said actuator support portion is adapted to be releasably connected to said base portion releasably connected to said base portion by a removable pin, and wherein said push block is releasably connected to said drive rod by a removable pin; said slicing apparatus adapted to be mounted on a vertical wall surface, said slicing apparatus additionally comprising a mounting plate, said mounting plate having a base-mounting surface and a wall-mounting surface, said base-mounting surface adapted to be removably attached to said base portion, and said wall-mounting surface adapted to be permanently attached to a vertical wall surface, said base-mounting surface and said wall-mounting surface being arranged at an angle to one another such that, when said mounting plate is attached to said wall and said base portion, said drive rod is maintained at an angle to said vertical wall surface.

9. A slicing apparatus according to claim 8, wherein said actuator is a pneumatic actuator.

10. A slicing apparatus according to claim 8, wherein said apparatus additionally comprises a switch controlling said actuator and wherein said switch is activated upon closure of said cover over said slicing area.

11. A slicing apparatus according to claim 10, wherein said actuator is a pneumatic actuator.

12. A slicing apparatus according to claim 8, wherein said drive rod has a drive rod longitudinal axis and wherein said actuator is adapted to direct a driving force through said drive rod longitudinal axis.

13. A slicing apparatus according to claim 8, wherein said drive rod is adapted to reciprocate within said slicing area.

* * * * *